US008069607B2

(12) United States Patent
Ballard

(10) Patent No.: US 8,069,607 B2
(45) Date of Patent: Dec. 6, 2011

(54) GUN SIGHT CONFIGURED FOR PROVIDING RANGE ESTIMATION AND/OR BULLET DROP COMPENSATION

(76) Inventor: Marlin Daniel Ballard, Austin, TX (US)

( * ) Notice: Subject to any disclaimer, the term of this patent is extended or adjusted under 35 U.S.C. 154(b) by 260 days.

(21) Appl. No.: 12/584,333

(22) Filed: Sep. 3, 2009

(65) Prior Publication Data

US 2010/0299987 A1 Dec. 2, 2010

Related U.S. Application Data

(60) Provisional application No. 61/217,353, filed on Jun. 1, 2009.

(51) Int. Cl.
*F41G 1/033* (2006.01)

(52) U.S. Cl. ..... 42/140; 42/111; 42/125; 42/133; 42/148

(58) Field of Classification Search ..... 42/111, 42/124–126, 128, 133, 136–141, 148; 89/41.17
See application file for complete search history.

(56) References Cited

U.S. PATENT DOCUMENTS

| | | | | | |
|---|---|---|---|---|---|
| 830,442 | A * | 9/1906 | King | 42/140 |
| 861,652 | A * | 7/1907 | Hawkins | 42/136 |
| 1,027,892 | A * | 5/1912 | Peck | 42/140 |
| 1,365,236 | A | 1/1921 | Fletcher | |
| 1,433,422 | A * | 10/1922 | Spencer | 42/140 |
| 1,466,913 | A * | 9/1923 | Matthews | 42/140 |
| 1,586,413 | A * | 5/1926 | Doornbos | 42/140 |
| 2,677,472 | A | 5/1954 | Kocur | |
| 2,904,888 | A * | 9/1959 | Niesp | 42/141 |
| 3,455,027 | A | 7/1969 | Perkins | |
| 3,568,324 | A * | 3/1971 | Jorczak | 42/142 |
| 4,017,995 | A * | 4/1977 | Hughes, Jr. | 42/136 |
| 4,162,579 | A | 7/1979 | James | |
| 4,993,158 | A * | 2/1991 | Santiago | 42/135 |
| D429,789 | S | 8/2000 | Sheehan | |
| 6,360,471 | B1 | 3/2002 | Stein | |
| 6,732,467 | B1 * | 5/2004 | Luth | 42/138 |
| 7,181,882 | B2 | 2/2007 | Woodbury | |
| 7,200,943 | B2 | 4/2007 | Afshari | |
| 7,200,944 | B2 | 4/2007 | Rager | |
| D546,916 | S | 7/2007 | Schwerman | |
| 7,243,432 | B1 | 7/2007 | Rager | |
| 7,343,686 | B2 | 3/2008 | Rager | |
| 7,356,962 | B2 * | 4/2008 | Swan | 42/147 |
| 7,726,229 | B2 * | 6/2010 | Schwerman et al. | 89/41.17 |
| D622,346 | S * | 8/2010 | Ballard | D22/109 |
| D622,803 | S * | 8/2010 | Ballard | D22/109 |
| D631,124 | S * | 1/2011 | Ballard | D22/109 |
| 2008/0276519 | A1 * | 11/2008 | Ballard | 42/143 |
| 2008/0276520 | A1 * | 11/2008 | Ballard | 42/143 |
| 2009/0049734 | A1 * | 2/2009 | Storch et al. | 42/136 |
| 2009/0071056 | A1 * | 3/2009 | Storch et al. | 42/137 |
| 2009/0188147 | A1 * | 7/2009 | Schwerman et al. | 42/148 |

* cited by examiner

*Primary Examiner* — Michael David
(74) *Attorney, Agent, or Firm* — David O. Simmons

(57) ABSTRACT

A front sight has a main body, a sight post body carrier, and a sight post body. The main body has an engagement structure for having a sight post body carrier movably engaged therewith and has a mounting structure for being attached to a weapon. The sight post body carrier is moveably engaged with the engagement structure of the main body in a manner allowing the sight post body carrier to be selectively translated at least partially along a length of the engagement structure and limiting unrestricted movement of the sight post body carrier in other directions. The sight post body includes a plurality of different length sight posts. The sight post body is moveably mounted on the sight post body carrier in a manner allowing each one of the sight posts to be selectively moved to a sight post use position with respect to the main body.

8 Claims, 4 Drawing Sheets

GUN SIGHT CONFIGURED FOR PROVIDING RANGE ESTIMATION AND/OR BULLET DROP COMPENSATION

CROSS REFERENCE TO RELATED APPLICATIONS

This patent application claims priority from co-pending U.S. Provisional Patent Application having Ser. No. 61/217,353, filed Jun. 1, 2009, entitled "Range Estimating, Bullet Drop Compensating, Front Firearm Sight", having a common applicant herewith and being incorporated herein in its entirety by reference.

FIELD OF THE DISCLOSURE

The disclosures made herein relate generally to gun sights and, more particularly, to gun sights configured for providing range estimating and/or bullet drop compensating functionalities.

BACKGROUND

Traditionally, front sight posts have been placed on the tip of the discharge end of a firearm barrel, and are usually oriented in one of two ways. A first way in which a front sight post is oriented is such that is vertically positioned with a very small column that is round or square in cross section, and perpendicular to the longitudinal axis of the firearm barrel. A second way in which a front sight post is oriented is such that is horizontally aligned with the longitudinal axis of the firearm barrel and has a cylindrical shaped so that the shooter sees the sight in cross-section, in which it appears to be a round dot when aligned with a rear aiming sight of the firearm. Regardless of the shape of the front sight post, the shooter visually aligns the front sight post of the firearm with both the target and a gap, hole, etc of the same or similar shape on the rear aiming sight of the firearm.

A shortcoming of known front aiming sight posts for firearms is that their overall configuration (e.g., their shape and size) serves little function that aids in accuracy when a target is not in close proximity to a firearm on which the sight is mounted. More specifically, although the sight may allow the shooter to establish a line of sight (or referred to in shooting parlance as 'line of aim') from the rear sight through the front sight post to the target, it does nothing to help the shooter estimate the distance to the target, nor does it indicate to the shooter how much to raise the barrel of the firearm above the line of aim in order to hit a distant target. The amount that the tip of the barrel needs to be raised to hit a distant target is referred to as BDC (bullet drop compensation).

Many magnified and unmagnified scopes and non-optical sights include a feature for providing BDC functionality. Such a BDC-providing feature on a firearm scope or sight (i.e., a sighting apparatus), when it is included, is usually an integral feature instead of a separate device. A BDC device (i.e., a device that provides for BDC functionality) can be used to predict a curvilinear trajectory of a given projectile propelled by a specific ammunition, shot toward a certain distant target from a particular firearm, and within a certain set of environmental conditions. These are a partial collection of factors by which the curvilinear trajectory can be determined, as there are additional factors that can influence such determination. Therefore, it is of particular importance to emphasize that when any one of a multitude of factors changes, a BDC device that previously worked with high degree of accuracy may be of limited or no aid in assisting the shooter in hitting a distant target.

It must also be noted that a BDC device is essentially worthless without a method to estimate distance to a target. Although, many manufacturers apparently expect shooters to accurately estimate how far it is to a distant target because BDC devices typically do not have an integral means for reliably determining or estimating distance to a target. To demonstrate why a distance measuring function is essential, the theoretical example of a target at 200 yards and 300 yards will be compared. Assuming that an average firearm has been adjusted to accurately hit a target at 200 yards using a fixed sight on the firearm (i.e., sighted-in at 200 yards), and the same firearm was then shot at a target at 300 yards without any changes in the adjustments to the fixed sight, the point of impact on the target at 300 yards can be more than eight inches below the center, assuming all other factors are the same and there is no operator error. At 400 yards, the error can be in excess of 24 inches, whereby if the target was close to the ground, the projectile could impact the ground long before it got to the target.

Therefore, a front sight configured to help a shooter of a weapon estimate distance to a target and to indicate to the shooter how much to raise the barrel of the weapon for above the line of aim for BDC would overcome shortcomings associated with known gun sights thereby making it advantageous, desirable and useful.

SUMMARY OF THE DISCLOSURE

Embodiments of the present invention provide a gun sight configured to help a shooter of a weapon estimate distance to a target and to simultaneously and automatically indicate to the shooter how much to raise the barrel of the weapon above the line of aim for bullet drop compensation (BDC). More specifically, embodiments of the present invention include a stationary sight post with an apparatus that serves as a sight post and simultaneously provides the additional functions of BDC and range-to-target distance estimation. In some embodiments, these functionalities are accomplished by replacing the single post front sight with a multi-post front sight configured in accordance with the present invention. Accordingly, sights configured in accordance with the present invention improve shooting accuracy by allowing distance to a target to be quickly and easily assessed and by simultaneously providing a means for aiding a shooter in rapidly and simply determining an amount to adjusting a weapon's elevation to compensate for needed changes in the projectile's trajectory in order to hit a distant target. An additional usefulness is that sights configured in accordance with the present invention add greater utility to any weapon by making its sighting devices more precise over a wider range of distances in comparison to known (i.e., prior art) gun sights. It is disclosed herein that, while a sight configured in accordance is particularly useful as a front sight, a sight configured in accordance with the present invention is not limited to being used as a front sight.

A front sight configured in accordance with the present invention is particularly well suited for a rifle used in law enforcement and/or military applications. However, such a front sight can readily be used in other types of applications (e.g., hunting animals, target shooting, etc). Accordingly examples of a distant target include, but are not limited to, an enemy combatant in military applications, an animal in hunting applications, and a paper target in competition applications.

In one embodiment of the present invention, a sight post body comprises a mounting portion and a plurality of spaced apart sight posts each attached to and extending from the mounting portion. The mounting portion is configured for allowing the sight post body to be moveably mounted on a support structure. Each one of the sight posts terminates at a respective tip portion having an end face. The end face of a first one of the sight posts is a first distance from a common reference point of the mounting portion. The end face of a second one of the sight posts is a second distance, substantially different than the first distance, from the common reference point of the mounting portion.

In another embodiment of the present invention, a sight for a weapon comprises a main body and a sight post body. The main body has a mounting structure configured for being attached to the weapon. The sight post body includes a mounting portion and a plurality of spaced apart sight posts attached to and extending from the mounting portion. The mounting portion is attached to the main body in a manner allowing each one of the sight posts to be selectively moved to a sight post use position with respect to the main body. Each one of the sight posts terminates at a respective tip portion having a substantially flat end face. The flat end face of a first one of the sight posts is a first distance from a common reference point of the mounting portion. The flat end face of a second one of the sight posts is a second distance, substantially different than the first distance, from the common reference point of the mounting portion.

In another embodiment of the present invention, a sight for a weapon comprises a main body, a sight post body carrier, and a sight post body. The main body has an engagement structure configured for having the sight post body carrier movably engaged therewith and has a mounting structure configured for being attached to the weapon. The sight post body carrier is moveably engaged with the engagement structure of the main body in a manner allowing the sight post body carrier to be selectively translated at least partially along a length of the engagement structure and limiting unrestricted movement of the sight post body carrier in directions other than along the length of the engagement structure. The sight post body includes a plurality of different length sight posts. The sight post body is moveably mounted on the sight post body carrier in a manner allowing each one of the sight posts to be selectively moved to a sight post use position with respect to the main body.

In another embodiment of the present invention, a sight for a weapon comprises a main body, a sight post body carrier and a sight post body. The main body has a channel configured for receiving the sight post body carrier therein and has a mounting structure configured for being attached to the weapon. The sight post body carrier is slideably mounted within the carrier channel of the main body in a manner allowing the sight post body carrier to be selectively translated at least partially along a length of the carrier channel and limiting unrestricted movement of the sight post body carrier in directions other than along the length of the carrier channel. The sight post body includes a plurality of spaced apart sight posts. The sight post body is rotatably mounted on the sight post body carrier in a manner allowing rotation of the sight post body about an axis of rotation thereof such that each one of the sight posts can be selectively moved to a sight post use position with respect to the main body. Each one of the sight posts extends outwardly along a respective radial axis extending through the axis of rotation of the sight post body and terminates at a respective tip portion having an end face. A length of each one of the sight posts, as measured from the axis of rotation to the end face thereof, is substantially different from each other.

Accordingly, it can be seen that embodiments of the present invention pertain to front aiming sights for weapons (e.g., firearms), and more specifically to improving functionality of a traditional (i.e., prior art) front sight post. A front sight in accordance with the present invention provides standard sight post functionality (i.e., left/right and up/down aiming), but also simultaneously provides the additional functions of bullet drop compensation (BDC) and range-to-target distance estimation. As discussed below in greater detail, such BDC and range-to-target distance estimation functionalities are provided through use of a sight post body having a plurality of sight posts of different lengths in place of a conventional (i.e., prior art) single stationary front sight post. A front sight in accordance with an embodiment of the present invention improves aiming accuracy by allowing a distance from a weapon to a target to be quickly and easily assessed and by allowing an elevation of the weapon (i.e., angle of trajectory) to be rapidly adjusted to compensate for needed changes in trajectory of a projectile shot from the weapon in order to accurately hit a distant target. An additional purpose is to add greater utility to any weapon by making its sighting devices more precise over a wider range of distances in comparison to a conventional front sight. Unlike a front sight in accordance with an embodiment of the present invention, a conventional front sight of a weapon does not provide a shooter of the weapon with any feedback regarding distance to a target, nor does it provide a method to compensate for the changing trajectory of the bullet/projectile, which is required for different distances from the weapon to the target.

These and other objects, embodiments, advantages and/or distinctions of the present invention will become readily apparent upon further review of the following specification, associated drawings and appended claims.

DETAILED DESCRIPTION OF THE DRAWING FIGURES

As will be understood and appreciated from the following disclosures, embodiments of the present invention combine the distance-to-target estimation (i.e., distance estimation) functionality with that of bullet drop compensation BDC) functionality without making any computations prior to shooting. In this manner, embodiments of the present invention avoid the use of a secondary device(s) to estimate distance and the amount of rise (upward movement) in the vertical angle of the weapon's barrel in order to hit a distant target (i.e., BDC). These two functionalities are accomplished simply by the shooter with limited mental considerations (e.g., without reference estimations/calculations) by just looking at multiple sight posts of an indexable sight post body of a front sight and by choosing one of such sight posts that matches an apparent visual size of a distant target. Because mental considerations prior to shooting are limited, a front sight configured in accordance with the present invention will provide a shooter with faster target acquisition especially in situations of high stress and/or intensity, shooting on the run, or while shooting in postures that are not optimum. Granted, the shooter may have to dial-in a different sight post to fit a new shooting scenario, but that process is much faster than making computations and then making changes to another type of aiming aid/device.

It is important to understand that the distance-to-target estimation functionality is the same from weapon to weapon and in different environments because such functionality relies only on matching an apparent visual size of a distant target and an apparent visual size of a chosen sight post. Accuracy of the distance estimation functionality is affected by a shooter who places their sighting eye at a different distance from the sight post than was used in sighting-in (i.e., standardizing) a sight post body carrying the sight posts of the sight post body. However, most implementations of mounting mechanisms used on removable front sights are adjustable over a significant distance along a mounting rail or barrel of a weapon, which provides a means for correcting differences in a shooter's habits.

It must be noted that, for a given distance, BDC will vary among weapons and shooting scenarios because the trajectory characteristics of the projectile after leaving the weapon are affected by a multitude of factors. Examples of such factors include, but are not limited to, ammunition configuration/variation, altitude, latitude, temperature, barrel condition, barrel twist, barrel length, flash suppressor configuration, silencer configuration, weapon center of gravity, etc. Nevertheless, the most critical factors affecting BDC accuracy are the characteristics of a weapon, configuration/variation of ammunition used in the weapon, and familiarity/proficiency of a shooter in using a front sight configured in accordance with the present invention.

Figure 1:
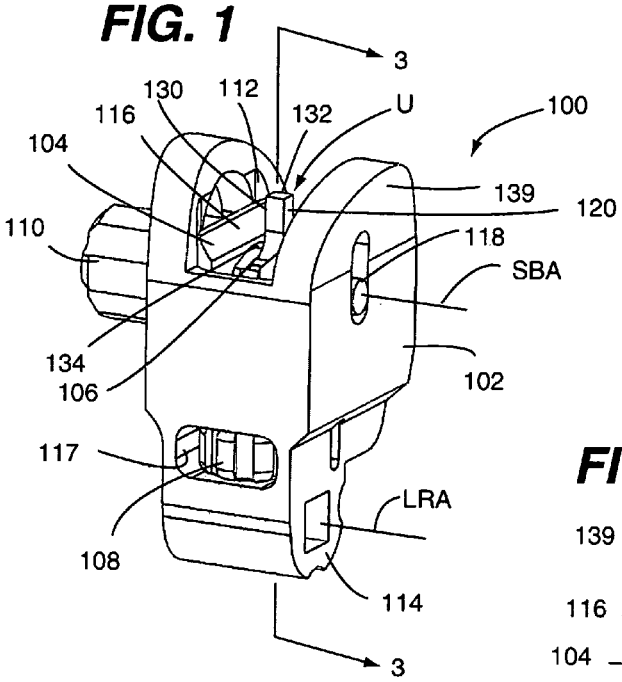
FIG. 1 is a front perspective view of a front sight having a front turning sight post body configured in accordance with an embodiment of the present invention.
Figure 2:
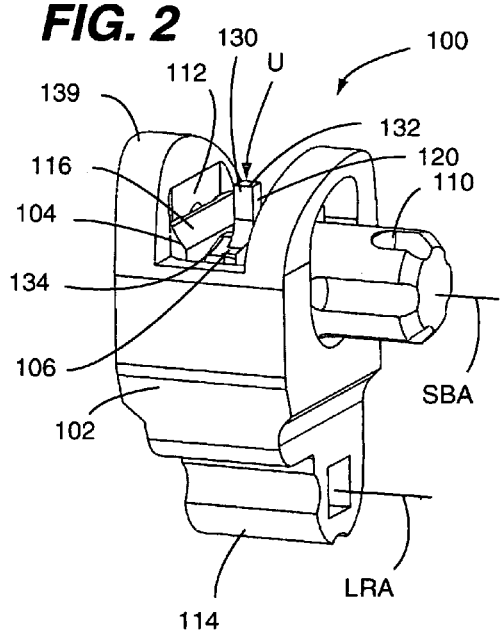
FIG. 2 is a rear perspective view of the front sight shown in FIG. 1.
Figure 3:
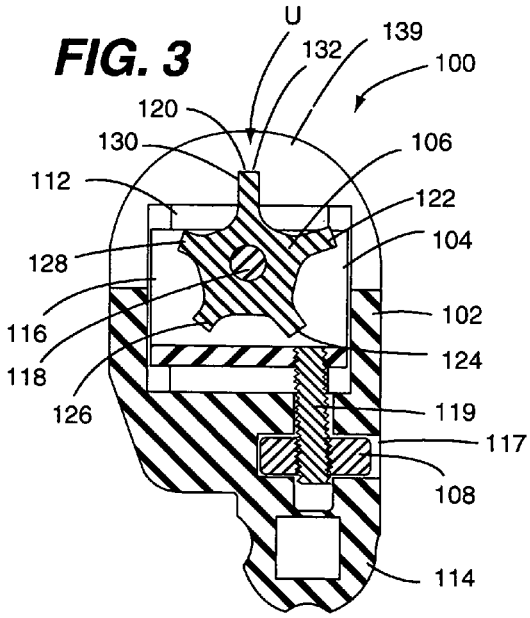
FIG. 3 is a cross-sectional view taken along the line 3-3 in FIG. 1.

Referring now to FIGS. 1-3, a front sight 100 configured in accordance with an embodiment of the present invention is shown. The front sight 100 includes a main body 102, a sight post body carrier 104, a sight post body 106, an elevation adjustment nut 108 and a post body rotation knob 110. The main body 102 has a channel 112 configured for receiving the sight post body carrier 104 therein and has a mounting structure 114 configured for being attached to a weapon. The sight post body carrier 104 is slideably mounted within the carrier channel 112 in a manner allowing the sight post body carrier 104 to be selectively translated at least partially along a length of the carrier channel 112 and limiting unrestricted movement of the sight post body carrier 104 in directions other than along the length of the carrier channel 112. The carrier channel 112 is one example of an engagement structure configured for having the sight post body carrier 104 movably engaged therewith. In view of the disclosures made herein, a skilled person will appreciate other engagement structures that allow the sight post body carrier 104 to be selectively translated at least partially along a length of such structure and that limits unrestricted movement of the sight post body carrier 104 in directions other than along the length of such structure.

The sight post body 106 is positioned between upstanding arms 116 of the sight post body carrier 104. A shaft 118 extends through apertures in the sight post body 106 and each one of the upstanding arms 116, thereby allowing the sight post body 106 to be rotated with respect to the sight post body carrier 104 about a rotational axis (i.e., sight post body axis SBA) defined by the shaft 118. However, it is disclosed herein that in at least one embodiment of the present invention, the sight post body 106 can be mounted directly on the main body 102.

The post body rotation knob 110 is attached to the shaft 118 for controlling rotation of the sight post body 106. As shown, the sight post body axis SBA extends substantially perpendicular to the barrel centerline axis BCA of a weapon (e.g., weapon 136) on which the front sight 100 is mounted and substantially parallel to a lateral reference axis LRA of the main body 102. The lateral reference axis LRA extends substantially perpendicular to the barrel centerline axis BCA of the weapon 136. Turning the post body rotation knob 110 causes the sight posts 120-128 to move in a front-to-rear or rear-to-front manner with respect to the barrel centerline axis BCA depending on the direction the post body rotation knob 110 is turned, thereby allowing each one of the sight posts 120-128 to be positioned in a use orientation U with respect to the main body 102. As such, the front sight 100 is referred to herein as having a front turning configuration. However, as disclosed below, a front sight configured in accordance with the present invention can have other rotational configurations. Examples of such other rotational configurations include, but are not limited to, a side turning configuration or a turntable-style configuration. As illustrated in FIG. 3, it is preferred that only the sight post in the use orientation U is within a line of aim of a shooter. It is disclosed herein that the sight post body 106 can be rotated through direct engagement of a finger with the sight post body 206 as opposed to through use of the post body rotation knob 110. As such, the post body rotation knob 110 can be an optional component.

Preferably, a positive positioning arrangement is provided between the sight post body 106 and the main body 102, sight post body carrier 106 or both. Such a positive positioning arrangement will serve the purpose of precisely and positively positioning each one of the sight posts 120-128 in the use orientation U. One example of such a positive positioning arrangement includes a spring-loaded (i.e., position biased) device that engages a mating detent feature when one of the sight posts 120-128 is in the use orientation U. In view of the disclosures made herein, as skilled person will be familiar with and/or devise other suitable positive positioning arrangements.

The sight post body 106 includes a plurality of sight posts 120-128. The sight posts 120-128 are spaced (e.g., uniformly) around an exterior edge portion of the sight post body 106. Thus, in view of the sight post body 106 being rotatably mounted on the sight post body carrier 104, the sight post body can be rotated in a manner allowing each one of the sight posts 120128 to be selectively rotated (i.e., moved) to the sight post use orientation U.

Each one of the sight posts 120-128 extends outwardly along a respective radial axis extending through the sight post body axis SBA axis and terminates at a respective tip portion 130 having an end face 132. A length of each one of the sight posts 120-128 is substantially different for each of the sight posts 120-128. As will be discussed below in greater detail, a relative apparent size (i.e., length) of each one of the sight posts 120-128 enables bullet drop compensation and range estimation functionalities in accordance with the present invention.

As shown in FIGS. 1-5, the end face 132 of each sight post 120-128 is substantially flat. However, it is disclosed herein that the tip portion of a sight post can be configured differently than having a substantially flat end face. Examples of such other configurations include, but are not limited to, the tip portion of a sight post including a bead or round object, the tip portion of a sight post including a crosshair, the tip portion of a sight post including an arrow, the tip portion of a sight post including upside down V-shaped feature (i.e., commonly referred to as a chevron), and the tip portion of a sight post including a lighted front sight post utilizing a glowing dot (e.g., such as by the use of fiber optics or tritium).

The elevation adjustment nut 108 is captured within a pocket 117 of the main body 102. A threaded stud 119 of the sight post body carrier 104 is in threaded engagement with the elevation adjustment nut 108. Through rotation of the elevation adjustment nut 108, the sight post body carrier 104 can be selectively translated at least partially along the length of the carrier channel 112, thus allowing the sight post body 106 to be vertically adjusted with respect to the main body 102 for sighting-in the front sight 100. The elevation adjustment nut 108, the threaded stud 119, the carrier channel 112 and the sight post body carrier 104 jointly define an elevation adjust structure in accordance with the present invention. In view of the disclosures made herein, a skilled person will appreciate other configurations of elevation adjust structures.

Embodiments of the present invention are not limited to any particular manner in which they can be attached to a weapon, as various approaches for attaching a front sight to a weapon are well known. Examples of such approaches include, but are not limited to, a barrel pinch clamp and a rail clamp. It is also well known that a front sight can be mounted in a fixed manner or in a manner allowing it to be pivoted between a use position and a stowed position.

Figure 4:
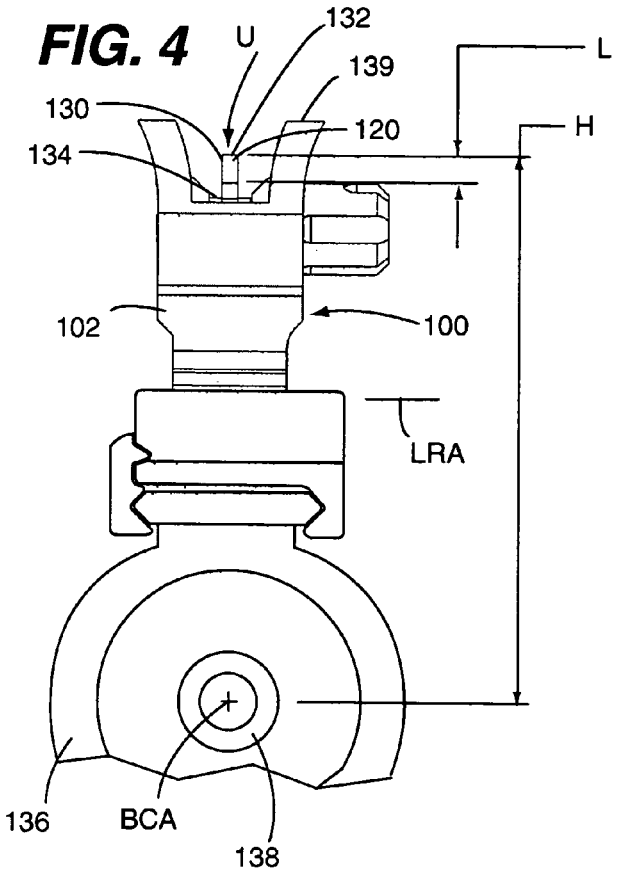
FIG. 4 is a front view of the front sight shown in FIG. 1, wherein the front sight is shown in mounted relationship to a weapon.
Figure 5:
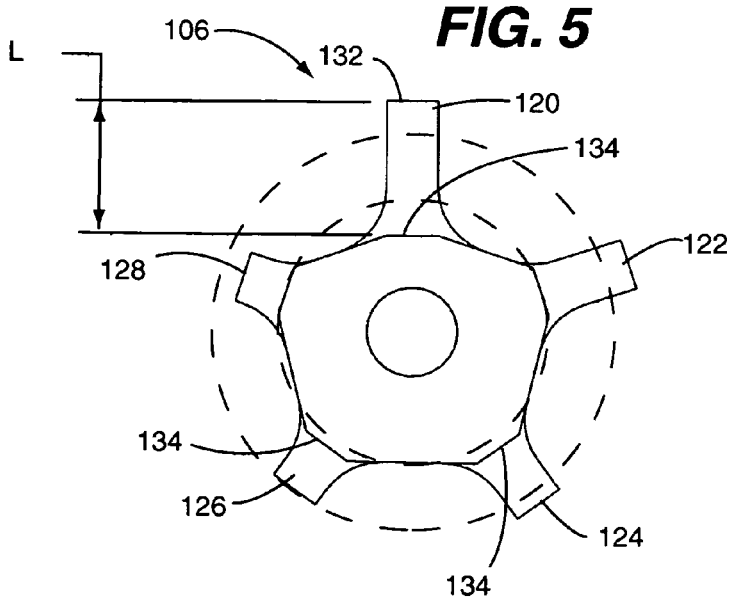
FIG. 5 is a side view of the front turning sight post body of the front sight shown in FIG. 1.

Embodiments of the present invention overcome shortcomings of known front sights through use of a moveably mounted, multi-post sight post body (e.g., the sight post body 106). As can be seen in FIGS. 4 and 5, each one of the sight posts 120-128 has a different length L as measured from the end face 132 thereof to a respective shoulder portion 134 of the sight post body 104 (i.e., the shoulder portion to which the sight post is attached to and extends from). As such, sight posts of a sight post body in accordance with the present invention are referred to as being differential length sight posts. Examples of a shoulder portion include, but are not limited to, a ledge, a transverse discontinuity in width, a point where a visual transition in width occurs, a point where a physical increase in width occurs, etc.

For a given mounting arrangement on a weapon 138 and a given position of the sight post body carrier 104 with respect to the main body 102, each one of the sight posts 120-128 also has a different height H as measured from the end face 132 thereof to a barrel centerline axis BCA of a barrel 138 of the weapon 136. The height H and length L jointly assist a shooter with closely estimating a distance to a distant target and with making bullet drop calculations so that firing elevation adjustment is provided for prior to shooting. It is important to make a distinction between the descriptors height and length as used in describing sight posts configured in accordance with the present invention. Referring to FIG. 4, the designations of height H and length L are shown in reference to the sight post body 106 of the front sight 100. Height H refers to a vertical distance above a centerline axis BCA of a longitudinal bore of the barrel 138 to an end face 132 at a tip portion 130 of the one of the sight posts 120-128 in the use orientation U. Thus, length L relates to distance-to-target estimation functionality of a front sight configured in accordance with the present invention and height H relates to BDC functionality of a front sight configured in accordance with the present invention.

As can be seen in FIGS. 1, 2 and 4, each shoulder portion 134 is substantially wider than is the attached one of the sight post 120-128. Each shoulder portion 134 serves as a visual indicator to a shooter of a point where the attached one of the sight posts 120-128 ends thereby allowing a shooter to readily recognize the length L of each one of the sight posts 120-128. Advantageously, such sight post configuration assists a shooter in estimating a distance to a distant target by comparing and matching an apparent visual size of the distant' target to an apparent visual size of the sight post in the use orientation U. The apparent visual size of a sight post in accordance with an embodiment of the present invention corresponds to its length L. Accordingly, by comparing and matching the apparent visual size of the distant target to an apparent visual size (i.e., as defined by the length L) of each sighting post, a sighting post having an apparent visual size most similar to the apparent visual size of the distant object can be readily determined. With the sight post body properly sighted-in (e.g., a reference one of the sight posts 120-128 being sighted in), the corresponding height of such most similar sight post provides for suitably accurate BDC when the most similar sight post is in the use orientation U and is properly aligned with a corresponding rear sight.

It is important to appreciate that length and height of sight posts of a front sight configured in accordance with the present invention advantageously provide for BDC and range estimation to be accomplished without any additional tools or equipment. Accordingly, by way of example, the set-up and use of such a front sight mounted on a weapon will now be described. Treating the front sight as a BDC sight, it is first sighted-in for 200 yards (i.e., a first target distance) using the sight post with the tip portion the greatest height above the barrel of the weapon (e.g., height H in FIG. 4), which will also be the sight post of greatest length. This sighting-in process includes firing a round from the weapon at a target at 200 yards and adjusting the vertical height of the sight post body of the front sight and/or the vertical height of the rear sight (if the rear sight is adjustable) until the fired projectile hits the center of the target. At this point, no additional elevation adjustment to the front sight will be made.

It is disclosed herein that, for a multi-post sight post body configured for a specific set of weapon parameters (e.g., sight placement distance relative to the eye, cartridge configuration, barrel rifling configuration), the sight posts that were not sighted in will be accurate for their respective intended ranges. For example, the sight post that has second greatest height above the barrel of the weapon will be accurate for a second target distance (e.g., 300 yards), and so on for each additional sight post. In this manner, for the specific set of weapon parameters, the BDC characteristics of the sight posts are predefined (e.g., highest post intended for 200 yards, second highest post intended for 300 yards, and so on). Such presumed accuracy is provided through computation used in determining sight post lengths for the specific set of weapon parameters, a related class of weapons or other suitable basis of computation.

A multi-post sight post body in accordance with the present invention is advantageously configured for allowing a shooter to visually estimate range of a distant target using the sight posts of the sight post body. The length of each one of the sight posts, which is defined above, is set by a mathematical calculation of the apparent size of the distant target. For example, at the naked eye of a shooter, a person (i.e., a target) will appear about half as tall (i.e., apparent size) at 400 yards as at 200 yards. Accordingly, the apparent size of the person at 200 yards is used as the length of the same post that was sighting in at 200 yards. The apparent size of a man at the second target distance (e.g., 300 yards) is used as the length of the same post that was designated above as corresponding to the second target distance, and so on for each additional sight post of the front sight. As disclosed above, the length of a sight post is the distance between the end face of the post and the shoulder portion of the sight post body to which the post is attached and from which it extends. In one embodiment (e.g., as shown in FIGS. 1, 2, 4 and 5), the shoulder portion is wider than a width of the sight post as viewed relative to a sighting face (i.e., the face observed during aiming) of the sight post. It is disclosed herein that the sighting face can be an actual planar face (e.g., a flat face of a square cross section post), a projected face (e.g., an as-viewed projected area of a round cross section post), or the like. In another embodiment (not shown), color can be used to define a length of a sight post. For example, the portion of the sight post corresponding to a length of the sight post can be a first color and a corresponding shoulder portion or a base portion of the sight post (e.g., if there is no defined shoulder) can be a second color, thereby using color to visually define a length of the sight post.

Accordingly, from the disclosures made herein, a skilled person will appreciate that the height of the end face of a sight post above the barrel centerline axis for a relatively long distance to target will be less than that for a sight post corresponding to a relatively short distance to target. Furthermore, from the disclosures made herein, a skilled person will appreciate that front sights configured in accordance with the present invention embody the inventive concept of a front sight having an indexable multi-post sight post body configured to provide BDC functionality and range estimation functionality (both functionalities are described above in detail). In summary, BDC functionality relates to a height of the tip of a particular sight post above a barrel to which the sight post is mounted such that the height of the end face of the sight post will provide for proper compensation for bullet drop for a target at a particular distance and a length of the particular sight post provides the sight post with an apparent visual size (i.e., length) at an eye of a shooter of the weapon that is substantially the same as an apparent size of the target (i.e., such that the apparent size of the target at the particular distance matches the size of the sight post).

In view of the disclosures made herein a skilled person will understand that sight post bodies having sight posts of different height and length can be used to provide suitably accurate shooting characteristics for different weapons and/or ammunitions. For example, a first weapon/ammunition configuration will require a sight post body having sight posts of a first height/length differentiation and a second weapon/ammunition configuration will require a sight post body having sight posts of a second height/length differentiation. In this manner, a sight post body can be configured specifically for a given set of parameters corresponding to a particular weapon/ammunition configuration or for a general set of parameters that will correspond to a class of weapons and/or specific collection of weapon/ammunition configurations.

As shown in FIGS. 1-4, the main housing 102 has post protecting arms 139 that are commonly referred to as wings or goalposts. The sight post body 106 is positioned between the post protecting arms 139 with the post protecting arms 139 extending above tallest one of the sight posts (i.e., sight post 120) when it is in the use configuration U. The position and shape of the post protecting arms 139 serve to protect the sight posts 120-128 from damage when in the use position U. The configuration (e.g., shape) of the post protecting arms 139 shown in FIGS. 1-4 is one example of a configuration of a sight post protection structure of the main body of a front sight. As shown, the post protecting arms 139 are outward sloping shaped wings commonly associated with and used on a M-16/M4 series of rifle. It should be noted that post protection arms of a front sight configured in accordance with the present invention can have numerous other configurations. For example, post protecting arms can be configured as inward sloping wings, such as those commonly associated with and used on various rifles offered by Heckler & Koch or can be configured to form a generally diamond shaped opening through which the sight post is viewed. However, it is disclosed herein that neither BDC functionality nor distance estimation functionality in accordance with the present invention is reliant upon post protecting arms. Their inclusion on the construction of a main body configured in accordance with the present invention does not impact BDC functionality or distance estimation functionality provided by front sights configured in accordance with the present invention.

Figure 6:
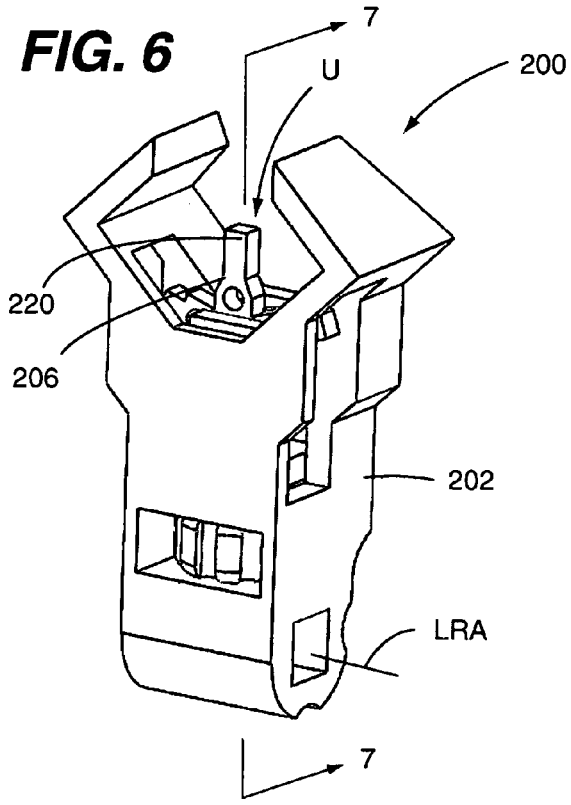
FIG. 6 is a front perspective view of a front sight having a side turning sight post body configured in accordance with an embodiment of the present invention.
Figure 7:
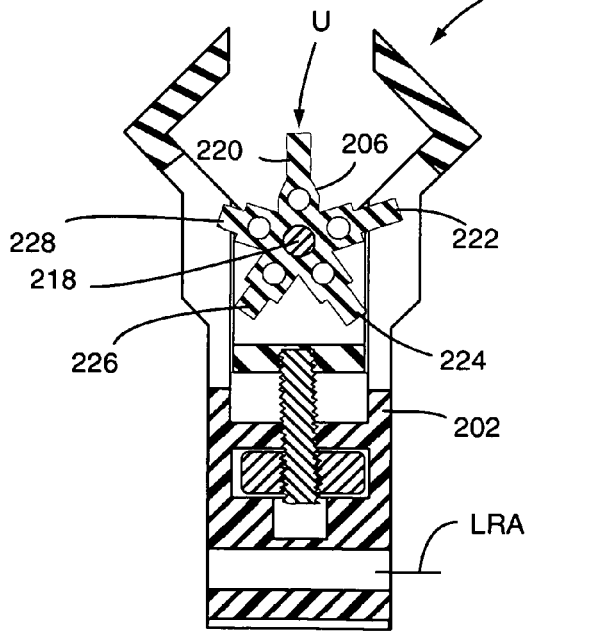
FIG. 7 is a cross-sectional view taken along the line 7-7 in FIG. 6.

FIGS. 6 and 7 show an embodiment of a front sight 200 having a side turning sight post body configured in accordance with the present invention. The underlying utility of the front sight 200 is effectively the same as that of the front sight 100 discussed above in reference to FIGS. 1-4, thus providing the front sight 200 with the same underlying functionalities (i.e., BDC and range estimation functionalities) as the front sight 100 discussed above in reference to FIGS. 1-4. The significant differences in the underlying construction of the front sight 200 stem from the front sight 200 having a side turning sight post body as opposed to the front turning sight post body of the front sight 100 discussed above in reference to FIGS. 1-4.

Turning now to a discussion of the key distinctions of the front sight 200 relative to the underlying construction of the front sight 100, the front sight 200 includes a sight post body 206 rotatably mounted on a shaft 218 defining pivot axis SBA that extends substantially perpendicular to a lateral reference axis LRA of the main body 202 of the front sight 200. The lateral reference axis LRA extends substantially perpendicular to the barrel centerline axis of a weapon on which the front sight 200 is to be mounted. In this manner, sight posts 220-228 of the sight post body 206 move in a clockwise or counter-clockwise direction as viewed along the pivot axis SBA, thereby allowing each one of the sight posts 220-228 to be positioned in the use orientation U with respect to the main body 202. The sight post body 206 can be rotated through direct engagement of a finger with the sight post body 206.

Figure 8:
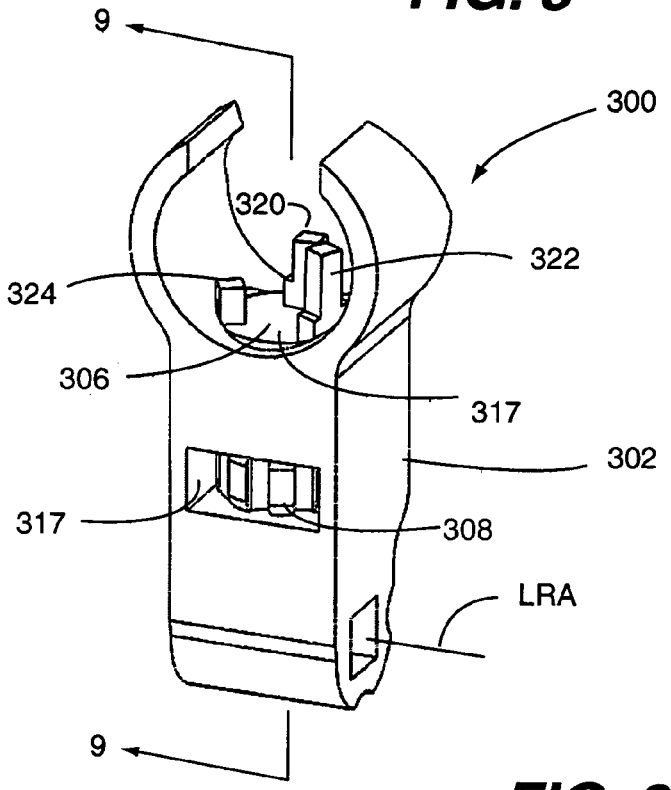
FIG. 8 is a front perspective view of a front sight having a turntable style sight post body configured in accordance with an embodiment of the present invention.
Figure 9:
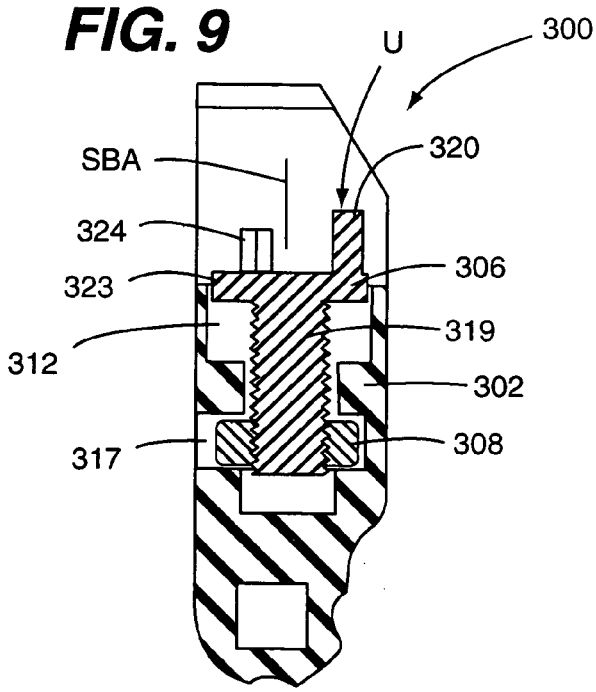
FIG. 9 is a cross-sectional view taken along the line 9-9 in FIG. 8.

FIGS. 8 and 9 show an embodiment of a front sight 300 having a turntable style sight post body configured in accordance with the present invention. The underlying utility of the front sight 300 is effectively the same as that of the front sight 100 discussed above in reference to FIGS. 1-4, thus providing the front sight 300 with the same underlying functionalities (i.e., BDC and range estimation functionalities) as the front sight 100 discussed above in reference to FIGS. 1-4. The significant differences in the underlying construction of the front sight 300 stem from the front sight 300 having a turntable style sight post body as opposed to the front turning sight post body of the front sight 100 discussed above in reference to FIGS. 1-4 or the a side turning sight post body of the front sight 200 discussed above in reference to FIGS. 6 and 7.

Turning now to a discussion of the key distinctions of the front sight 300 relative to the underlying construction of the front sight 100, the front sight 300 includes a sight post body 306 having a turntable structure 323 to which a plurality of sight posts 320-324 are mounted and extend from. The sight posts 320-324 extend vertically from a first side face of the table structure 323 and a threaded mounting stud 319 a second face of the a second side face of the table structure 323. The threaded mounting stud 319 is in threaded engagement with an elevation adjustment nut 308 disposed within a pocket 317 of the main body 302. Through rotation of the elevation adjustment nut 308, the sight post body 306 can be selectively translated at least partially along the length of a carrier channel 312 of the main body 302, thereby allowing the sight post body 306 to be vertically adjusted with respect to the main body 302. Thus, a pivot axis SBA of the sight post body 306 extends substantially perpendicular to a longitudinal reference axis LRA of the main body 302. The lateral reference axis LRA extends substantially perpendicular to the barrel centerline axis of a weapon on which the front sight 300 is to be mounted. In this manner, sight posts 320-324 of the sight post body 306 move in a clockwise or counter-clockwise direction as viewed along the pivot axis SBA of the sight post body 306, thereby allowing each one of the sight posts 320-324 to be positioned in a use orientation U with respect to the main body 302. The sight post body 306 can be rotated through direct engagement of a finger with the sight post body 306.

It is disclosed herein that a vertical pivot axis arrangement of a turntable style front sight is practical if the sight post body carries three or less sight posts because the sight posts not in the use orientation will not be within a line of aim of a shooter. However, for a turntable style front sight with four or more sight posts, a tilted axis arrangement with sight posts that extend in a slanted manner with respect to the pivot axis of the sight post body is preferred. Such a slanted sight post arrangement results in the sight posts not in the use orientation also not being within a line of aim of a shooter. Such a slanted sight post arrangement requires each sight post to be slanted away from a pivot axis of the sight post body. An axis extending vertically through the sight post in the use orientation extends perpendicular to the centerline axis of a barrel of a weapon on which the front sight is mounted and a rotation axis of the sight post body is skewed with respect to the lateral reference axis of the main body. For example, the axis extending through the sight post in the use position is skewed by 45 degrees with respect to the pivot axis of the sight post body and the pivot axis of the sight post body is skewed by 45 degrees with respect to the lateral reference axis of the main body. In this manner, the tilted pivot axis and slanted sight posts allows only one sight post to be in the shooter's line of aim (i.e., only the sight post in the use orientation is in the shooter's line of aim).

A skilled person will appreciate that sighting devices (e.g., a front sight) configured in accordance with the present invention can be configured to provide only BDC functionality in accordance with the present invention or range estimation functionality in accordance with the present invention. Such a device can be used as a stand-alone device to aid a shooter, especially if the shooter has other preferred methods of providing the functionality not provided by the device. For example, distance estimation functionality, which operates by comparing the apparent visual size of a distant object (such as a standing person) to the apparent visual size of one of the sight posts, can be incorporated into the device by itself without the inclusion of structure that provides the BDC functionality. Conversely, the device can be constructed to provide BDC functionality without incorporating structure therein for providing distance estimation functionality.

Accordingly, it is disclosed herein that a sighting device can be provided that provides only distance estimation functionality in accordance with the present invention. In one embodiment, such a distance estimation sighting device can be configured to have a plurality of in-line differential length sight posts. For example, the sight posts can be a plurality of upstanding posts that are uniformly spaced apart from each other. Such a device can be mounted to a weapon to aid the shooter in estimating target distance by comparing the apparent visual size of a distant target with the apparent size (i.e., length) of each one of the sight posts. Such a device can be mounted in a vertical or horizontal orientation and can be configured to be mounted via a mounting structure that attaches by any suitable means (e.g., snap-on, clamp-on, screw on, etc).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A sight for a weapon, comprising:

a main body having an engagement structure configured for having a sight post body carrier movably engaged therewith and having a mounting structure configured for being attached to the weapon;

a sight post body carrier moveably engaged with the engagement structure of the main body in a manner allowing the sight post body carrier to be selectively translated at least partially along a length of the engagement structure and limiting unrestricted movement of the sight post body carrier in directions other than along the length of the engagement structure; and a sight post body including a plurality of different length sight posts, wherein the sight post body is moveably mounted on the sight post body carrier in a manner allowing each one of said sight posts to be selectively moved to a sight post use position with respect to the main body and wherein the sight post body is rotatably mounted on the sight post body carrier for allowing the sight post body to be rotated about an axis of rotation;

each one of said sight posts extends outwardly along a respective substantially radial axis extending through the axis of rotation and terminates at a flat end face thereof, and a length of each one of said sight posts, as measured from the axis of rotation to said flat end face thereof, is substantially different from each other.

2. The sight of claim 1 wherein:

each one of said sight posts is attached to and extends from a respective shoulder portion of the sight post body; and a width of each one of said sight posts at a location of attachment to the respective one of said shoulders is substantially less than a width of the respective one of said shoulders at said attachment location.

3. The sight of claim 1 wherein:

each one of said sight posts extends outwardly along a respective radial axis extending through the axis of rotation and terminates at said flat end face, and a distance as measured from the axis of rotation to said attachment location of a first one of said posts is substantially different than a distance as measured from the axis of rotation to said attachment location of a second one of said posts.

4. The sight of claim 1 wherein:

a sighting face of each one of said sight posts extends substantially parallel to the axis of rotation.

5. The sight of claim 1 wherein:

a sighting face of each one of said sight posts extends substantially perpendicular to the axis of rotation.

6. A sight for a weapon, comprising:

a main body having a channel configured for receiving a sight post body carrier therein and having a mounting structure configured for being attached to the weapon;

a sight post body carrier slideably mounted within said channel of the main body in a manner allowing the sight post body carrier to be selectively translated at least partially along a length of said carrier channel and limiting unrestricted movement of the sight post body carrier in directions other than along the length of said carrier channel; and a sight post body including a plurality of spaced apart sight posts, wherein the sight post body is rotatably mounted on the sight post body carrier in a manner allowing rotation of the sight post body about an axis of rotation thereof such that each one of said sight posts can be selectively moved to a sight post use position with respect to the main body, wherein each one of said sight posts extends outwardly along a respective radial axis extending through the axis of rotation of the sight post body and terminates at an end face at a tip portion thereof, and wherein a length of each one of said sight posts, as measured from the axis of rotation to the end face thereof, is substantially different from each other.

7. The sight of claim 6 wherein a sighting face of each one of said sight posts extends substantially parallel to the axis of rotation.

8. The sight of claim 6 wherein a sighting face of each one of said sight posts extends substantially perpendicular to the axis of rotation.

* * * * *